United States Patent [19]

Anderson et al.

[11] Patent Number: 4,864,966

[45] Date of Patent: Sep. 12, 1989

[54] ROBOTIC AIRBRUSH APPARATUS

[75] Inventors: G. Scott Anderson; Jon D. Galetta, both of Orlando; D. Travis MacGregor, Tarpon Springs; Clarence F. Prince, Dunedin, all of Fla.

[73] Assignee: Automated Artists Corp., Clearwater, Fla.

[21] Appl. No.: 152,514

[22] Filed: Feb. 5, 1988

[51] Int. Cl.[4] ..... B05C 11/00

[52] U.S. Cl. ..... 118/668; 427/429; 427/421; 427/265; 118/323; 118/697; 118/302; 901/43

[58] Field of Search ..... 118/668, 323; 427/429, 427/421; 901/43; 448/302

[56] References Cited

U.S. PATENT DOCUMENTS

| | | | |
|---|---|---|---|
| 3,674,207 | 7/1972 | Carbonetti | 901/43 |
| 4,353,677 | 10/1982 | Susnjara | 901/43 |
| 4,448,820 | 5/1984 | Buschon | 118/668 |
| 4,486,843 | 12/1984 | Spongh | 901/43 |

OTHER PUBLICATIONS

"Robot Application: A Trio of Successes", Machinery and Production Engineering, 3 Feb. 1982, pp. 24–29.

*Primary Examiner*—Shrive Beck
*Assistant Examiner*—Vi Duong Dang
*Attorney, Agent, or Firm*—Ronald E. Smith; Joseph C. Mason, Jr.

[57] ABSTRACT

A robotic airbrush apparatus to apply color, pigment or paint to a surface in accordance with a preselected artwork configuration. The apparatus comprises in combination a robotic arm, a support for the arm, an airbrush mounted on the arm, a quill having an open free end and a proximal end attached in fluid communication with the airbrush, a paint pod acceptably bored for sliding engagement of the quill, a sensor mounted on the arm for determining the presence of the paint pod, a paint reservoir connected to the paint pod by means of a flexible conduit, and a computer program, such as a punched mat, for movement of the robotic arm in open engagement of the quill and paint pod and for movement of the airbrush together with the engaged quill and paint pod in accordance with the preselected artwork configuration. The apparatus also comprises a control valve on the airbrush and adjustable lever for opening and closing the control valve to adjust the amount of paint to be projected through the airbrush. Programmable instructions are also provided for the robotic arm to activate the lever on the airbrush.

27 Claims, 4 Drawing Sheets

ROBOTIC AIRBRUSH APPARATUS

TECHNICAL FIELD

This invention relates generally to the field of airbrush painting and apparatus therefor. It includes apparatus for creating two dimensional works of fine art, graphic art, applied art and technical drawings through the combination use of robotics.

BACKGROUND OF THE INVENTION

In the operation of airbrushes, the airbrush itself is hand held and the artist creates the color on the intended surface by hand and arm movements while triggering the airbrush mechanism to control the flow of paint being applied to the surface. It is tedious and exacting work. The artist is physically unable to reproduce the work exactly or to produce the work on any kind of assembly line fashion. In spite of even the best human eye-hand-arm coordination, the airbrush artist is left to a single or one-at-a-time produce, no two of which can be called reproductions of the original or first product. Creation of an airbrush painting is time consuming because of the frequent need to stop and clean the airbrush between each color change and the relatively slow arm and hand movements desired for exacting work, such as that required to tint a photograph. It is also tiring work because the airbrush is relatively heavy.

Airbrush painting utilizes compressed air from a nozzle to atomize paint. The nozzle operates by impinging turbulent air on or across a surface containing paint causing the paint to collapse into droplets which are then directed onto a surface. The general configuration of the airbrush includes a source of fluid, e.g. paint, which is connected to a control or needle valve. As air passes over the needle valve it creates a vacuum which draws fluid from a remote source out of the valve into the airstream where the fluid or paint is sprayed or projected onto a surface of paper or other material. As used herein, the term "paint" is intended to include color, pigment, paint or other colorants and fluids for creating images on a surface.

Frequently, the source of paint for use in airbrush painting is mounted on the airbrush itself by way of a screwed jar or container or similar source reservoir. This configuration creates space problems and adds weight to the airbrush, thereby making it all the more difficult for the human artist to perform exacting artwork for any extended period of time. Also, such configuration is messy an awkward when the jar or container must be changed for each change of color.

These and other shortcomings in airbrush painting are largely overcome by the present invention which combines airbrush technology with robotics.

There has been increased use of automated painting and coating apparatus such as in assembly lines in automobile plants or for coating a series of objects to be painted or otherwise coated as the objects pass a spray station. Some of these assembly lines have used computers for programming color changes during the assembly line operation and some use industrial robots to manipulate the painting process in a spray booth.

Broadly, industrial robots perform such tasks as welding, machine loading and unloading, material handling, spray finishing, assembly and machinery applications. The majority of industrial robots are not "smart" or "intelligent" manipulators largely because their ability to sense objects in their environment is still not perfected. In all practical applications, robots, for the most part, are deficient in vision and touch.

These and other deficiencies have heretofore made robotics unacceptable for detailed painting and artwork utilizing the exacting apparatus of an airbrush.

THE SUMMARY OF THE INVENTION

Preferably, the advantages of this invention may be realized by a robotic apparatus configuration and combination which includes a robotic airbrush apparatus to apply color, pigment, or paint to a surface such as fabric, paper, wood, metal or other materials in accordance with a preselected artwork image which apparatus in combination comprises a robotic arm, a support for the arm, an airbrush fixedly mounted on the arm, a quill having a distal free end and a proximal end in attached open communication with the airbrush, a paint pod acceptably bored for sliding engagement of the quill, a sensor mounted on the robotic arm for determining the presence of the paint pod, a paint reservoir connected to the paint pod by means of a flexible conduit, and a computer program, such as a punched mat, for movement of the robotic arm in open engagement of the quill and paint pod and for movement of the airbrush together with the engaged quill and paint pod in accordance with the preselected artwork configuration. The apparatus, in another embodiment, also may contain a control valve on the airbrush and an adjustable lever for opening and closing the control valve to adjust the amount of paint to be projected through the airbrush. In a further embodiment, the apparatus may include programmable instructions for the robotic arm to activate the activator lever on the airbrush. As used herein, the term "paint pod" includes a pod which may contain any fluid such as color, pigment, or paint.

In other aspects of the invention, by combining the motion of the airbrush, which is attached to the robotic arm, and the flow of paint through the airbrush, human motions can be simulated with more precision than the human artist is capable of. Further, combining a computer control of the robot with, say electronic control of the airbrush lever, provides the benefit of repeatability with consistent reproduced results that is virtually impossible with a hand-held airbrush. Practice of this invention provides a means for reproducing artwork with consistent high quality techniques.

Further aspects of the invention can include a robotic arm which is "jointed" and very closely resembles the human arm's anatomy. One preferred embodiment of the invention may include a robotic arm having six degrees of freedom.

Advantages of the invention may also be obtained by an apparatus for projecting paint to a remote acceptor surface which comprises in combination: a robotic arm; a support for the robotic arm; an airbrush fixedly mounted to the robotic arm; a quill mounted on the airbrush; a paint pod acceptably bored for sliding engagement of the quill; a paint reservoir connected to the paint pod by a conduit; first means for movement of the robotic arm in open engagement of the quill and paint pod; and, second means for movement of the robotic arm in connectable relationship with the openly engaged quill and paint pod to project paint from the paint reservoir through the conduit and through the airbrush to the remote acceptor surface.

Advantages of the invention may be obtained by an apparatus further comprising third means for movement of the robotic arm in accordance with predetermined artwork and configuration.

Advantages of the invention may be obtained by an apparatus further comprising sensor means for determining presence of the paint pod.

Advantages of the invention may be obtained by an apparatus further comprising a paint cleaner reservoir, a waste receptacle, and fourth means for movement of the robotic arm with disengagement of the quill and pod to immerse the quill and airbrush in paint cleaner and subsequent discharge of cleaner to the waste receptacle and position for reengagement of the quill and paint pod.

Advantages of the invention may be obtained by an apparatus wherein the third means further comprises valve means and selectable adjustable actuator means for opening and closing the valve means to adjust the amount of paint to be projected through the airbrush.

Advantages of the invention may be obtained by an apparatus wherein the paint pod further comprises housing means comprising a first section and a second section adapted to be connected to each other; the second section having an axial bore comprising means for connecting thereto the conduit, closure means within the bore being movable and reciprocally guided in the first housing means in the axial direction thereof; the first section having an axial bore and O-ring means at a position remote from the second section adapted for receipt of the closure means on its upstream side and for receipt of the quill on its downstream side and; spring means mounted within the first and second section and being under tension when the first and second sections are connected thereby forcing closure means against the O-ring means for preventing passage of paint out of the pod until the quill and pod are in open disengagement.

Advantages of the invention may be obtained by an apparatus further comprising programmable instruction means including an image to be projected on the remote acceptor surface for sequential activation of the second, third and fourth means.

Advantages of the invention may be obtained by an apparatus wherein said programmable instruction means further comprises a punched mat.

Advantages of the invention may be obtained by a robotic airbrush for creating artwork on a remote surface which comprises in combination: a robotic arm equipped with a gripper; a base to support the robotic arm; an airbrush fixedly mounted to the robotic arm wherein the aribrush contains valve means and selectable adjustable actuator means for opening and closing the valve; a quill mounted on the airbrush having a remote free end and the other end in open fixed communication with the airbrush; a plurality of selectable paint pods having an axial bore opening adapted to receive the quill, wherein each pod has paint flow opening and closure means; a container for the paint pods wherein the container comprises a plurality of grippers for holding the paint pods; a plurality of paint reservoirs, each connectable to one of the paint pods by flexible tubing; wherein the robotic arm further comprises programmable instruction means for movement of the robotic arm in sequential relationship for engagement of the quill and a selected paint pod by inserting the open end of the quill into the axial bore opening of the paint pod against the spring loaded means, thereby putting the paint reservoir in fluid communication with the airbrush for gripping the engaged paint pod; for activating the actuator means on the airbrush; for projecting paint from the paint reservoir through the conduit to the paint pod through the quill, the airbrush, to a remote surface in accordance with a preselected artwork configuration; and for returning the paint pod to gripped relationship with the grippers on the container.

THE BRIEF DESCRIPTION OF THE DRAWINGS

The invention, both as to its organization and method of operation, together with further aspects and advantages thereof, may be best understood by reference to the following description taken in connection with the accompanying drawings, in which.

DETAILED DESCRIPTION OF PREFERRED EMBODIMENTS

Figure 1:
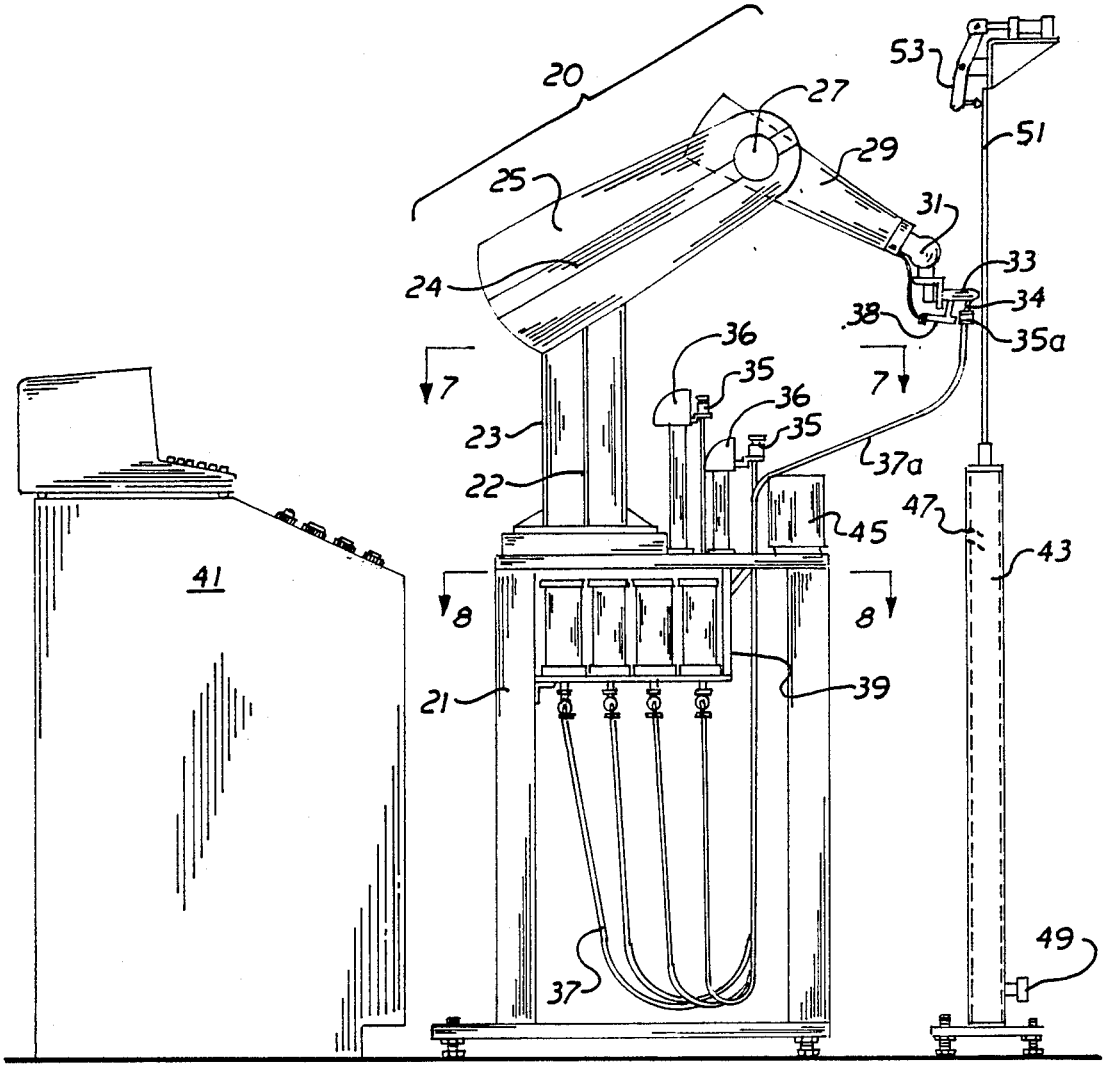
FIG. 1 shows an arrangement of an apparatus in accordance with the present invention.

Referring now FIG. 1, a side view arrangement of an apparatus in accordance with the present invention is illustrated. A robotic arm 20 and its anatomy is shown. Trunk or waist 23 rests on base support 21 and is rotatable about axis 22 through of arc of about 320 degrees. Attached to trunk 23 is a shoulder joint 24 which is separately rotatable through arc of about 250 degrees for the upper arm 25. Elbow 27 which is rotatable through an arc of about 270 degrees connects the upper arm 25 and lower forearm 29. The lower forearm 29 is configured at 31 for wrist rotation of about 300 degrees, wrist bend of about 200 degrees, and flange movement through about 532 degrees (not separately shown). The robotic arm as illustrated thus has six degrees of freedom, i.e., rotatable joints, and is preferred for practice of this invention although other robotic arms having from 2 to 5 degrees or more of freedom may in some cases be satisfactorily utilized.

Attached generally at wrist location 31 is an airbrush assembly 33 having hollow quill 34 fixedly attached at the proximate end of the quill to which, as illustrated, is an engaged paint pod 35*a;* the means of engagement comprising the sliding engagement of the free distal end (not shown) of quill 34 and the open bore (not shown) of pod 35*a*. Pod 35*a* is detachable from quill 34 for secure storage in holder 36. Sensor 38, such as a fiber optic sensor, is operational to inform the computer (not shown) contained in cabinet 41 that there is or is not present a paint pod for pick-up from holder 36. The computer circuitry, including controllers, disk drives, floppy disks and cables, contains the means for controlling the movements of the robotic arm and color selection, if any, and need not be shown in the drawings for purposes of illustrating the various embodiments of the invention.

Paint pods 35 can be numerous and may vary in number from 1 to 100 or more depending upon the color scheme desired by the operator or artist, and are in fluid communication with an equal number of paint reservoirs 39 by means of flexible conduits 37 such as plastic tubing. Also, the apparatus may contain cleaning reservoir 45 for purposes of cleaning the airbrush assembly from time to time.

In its method of operation, and for purposes of illustration, fluids such as color, pigment, or paint may be projected from airbrush assembly generally shown at 33 onto surface 51 which is detachable but generally held in a substantially stationary position by clamping means 53, which can be a spring loaded clamp. After a cleaning of the airbrush, discharge of waste material can conveniently be through waste receptacle opening 47 into the hollow support 43 for surface 51 which support 43 acts as a waste material reservoir. Waste material may be conveniently removed from the reservoir or hollow support 43 by means of valve 49 which may be opened and closed manually or automatically by means known to the art (not shown). Other means of disposing of waste material may be devised by those skilled in the art without departing from the scope of this invention.

For its method of operation, and preferably, paint reservoirs 39 are kept under positive air pressure, say, from 2 to 20 pounds per square inch gauge (psig), preferably 6–12 psig, (by means not shown) in order to force the flow of paint from reservoir 39 through conduit 37 through pod 35a into airbrush 31 by way of hollow quill 34 which is confluent with pod **35*a*. Optionally, paint reservoirs 39 may be in an elevated location (not shown) appropriate for gravity flow of the paint through the apparatus, in which case a source for air pressure to the reservoirs 39** may not be needed.

Figure 2:
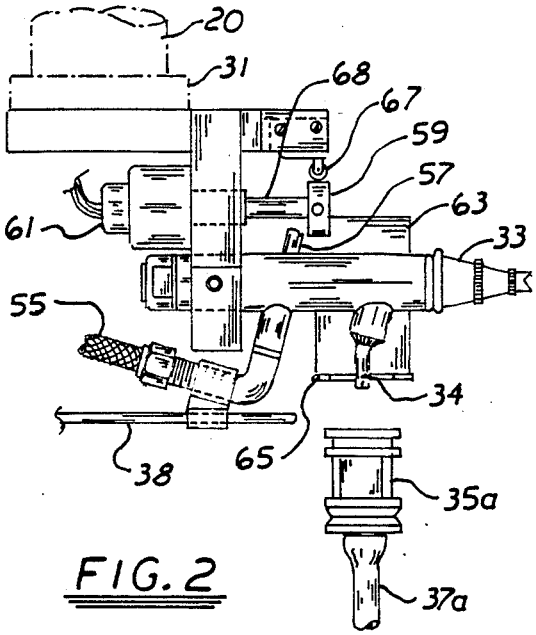
FIG. 2 shows a side elevation of an airbrush attached to a robotic arm.
Figure 3:
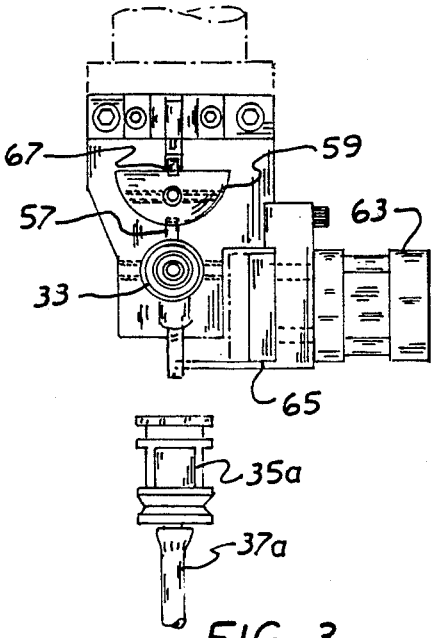
FIG. 3 shows a front elevation of an airbrush attached to a robotic arm.
Figure 5:
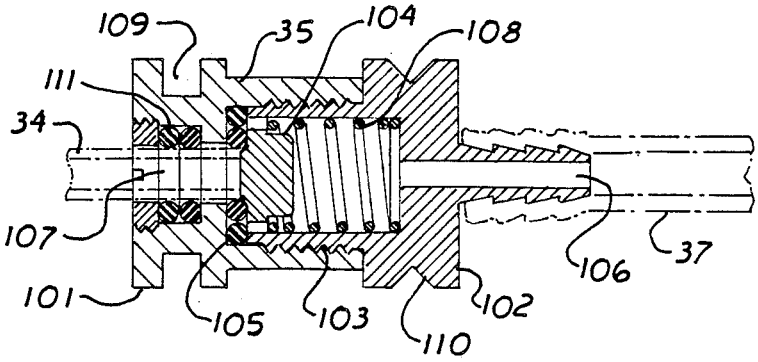
FIG. 5 shows a section view of a paint pod.

Referring now to FIG. 2 and FIG. 3, airbrush 33 is shown as attached to robotic arm 20 generally at the wrist location 31 so that airbrush 33 will move with the same movements as the robotic wrist 31 upon instruction. A paint pod **35*a* is shown in spaced relation to quill 34 with substantially vertical alignment of the distal end of the quill with the axial bore of the paint pod 35 or 35*a*, which bore is shown in FIG. 5 at 107. The quill 34, preferably, is bent appropriately for such axial alignment so that the paint pod is substantially vertical during operation. However, insertion of the distal end of the quill 34 into pod 35 can be in other positions without departing from the advantages of this invention. Supply of paint to airbrush 33 is from flexible conduit 37 (when stored) or 37a (when attached). Activator lever 57 controls the amount of compressed air being supplied to the airbrush from hose 55 confluent with a source of air under positive pressure (not shown). Movement of the lever 57 is by engagement of contact or rake 59 which in turn is moved by motor 61 which may be electric, electronic, pneumatic, or hydraulic in its operation. As a further embodiment, contact sensor (shown as a half-moon) 67 is used to orient contact 59 with the "home" position of lever 57**. By such "home" position determination very precise regulation of air flow can be obtained on a repetitive basis.

Movement of lever 57 is in an essentially closed position when toward the proximate end of the airbrush and in an essentially fully open position when moved toward the distal end of the airbrush assembly. Lever 57 is always under tension, e.g. by a spring, for closure (not shown). This control mechanism is used to regulate the flow of fluid, e.g. paint, out of the airbrush. It, for all practical purposes, performs mechanically with precision, the same function as the second finger of airbrush artists. This mechanism moves the lever or trigger to and for which in turn moves the internal needle of the airbrush (not shown) allowing fluid to flow through the airbrush. Preferably this movement is accomplished using a synchronous motor, such as an hysteresis motor, at 61 with a rake 59 at the end of the motor shaft 68. The rake 59 pulls and releases the lever or trigger 57 as the motor 61 receives energized/nonenergized signals from the robot controller (not shown). These positional signal changes, preferably, occur throughout the running of the computer program stored in housing 41 of FIG. 1. The "home" position, using sensor 67, is maintained, preferably, by a microswitch sensor that sets the motor 61 into a constant "home" position from which it can move to other positions.

Air cylinder 63, preferably, is the means for activating or movement of grippers 65 into and out of locked relationship with paint pod 35. Other means for activating such grippers may work equally well. Preferably, these grippers 65 operate as a clamp forcing the engaged pod **35*a* against the outer rim of its axial bore thereby holding the pod 35*a*** in open engagement with the airbrush.

Figure 4:
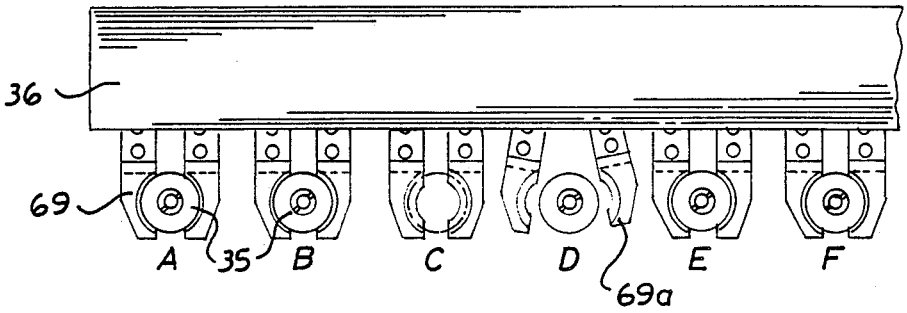
FIG. 4 shows one partial plan view of a paint pod container.

Referring now to FIG. 4, paint pod holder 36 is shown with a multiplicity of holding positions designed for illustrative purposes as positions A through F, etc. As stated above, there can be any number of such positions limited only by the desires for color by the artist and by the limits of operation of the robotic arm. Holder 36 also has quick-operating, quick-closing grippers 69 at each location for holding and releasing paint pods 35. Position D shows gripper **69*a* in open configuration. Position C shows an empty holder. Preferably, grippers 69** operate as an ordinary pair of pliers activated, however, by electric, electronic, pneumatic, or hydraulic means (not shown) but other gripping or locking devices may be used.

In operation during a program, preferably, when the robotic arm 20 is instructed to go and pick-up a pod 35 at position C, sensor 38 (FIG. 2) would indicate that no pod was present in which case the apparatus would stop in a pause mode until instructed by the operator to move again. Such sensing operates as an advantage to avoid errors in the preselected paint image of the program.

Referring now to FIG. 5, one embodiment of paint pod 35 is shown in cross-sectional plane. Pod 35 comprises preferably, two sections: a first section 102 having annular indentation 110 for engagement by gripper 69 of FIG. 4. Section 102 also has an axial bore 106 to which is attached in open communication flexible conduit 37 from the paint reservoir 39 (not shown here) and has contained therein spring means 108 under compression which forces cap 104 against O-ring seal 105 embedded in second section 101 of pod 35. Section 101 has been acceptably bored sufficient to slidingly accept engagement of quill 34 through opening therein 107. O-ring 111 operates as a seal when cap 104 is moved away from O-ring 105 by forceful contact of quill 34 with cap 104. Section 101 also has annular indentation 109 for engagement by grippers 65 when the apparatus is in its painting mode. Sections 101 and 102 constitute the housing for pod 35 and preferably are connected by thread means 103 although other engaging means may be used to put sections 101 and 102 into functional relationship without departing from the advantages of this invention. Optionally, it may be desirable to place a mesh filter (not shown), e.g. cheese cloth or metal, in the housing section 102 such as under the ring seat for spring 108 in order to substantially filter out interfering particulate matter in the fluid from reservoir 39. Other locations for the filter within the paint flow circuit prior to the airbrush nozzle may work equally well.

Figure 6:
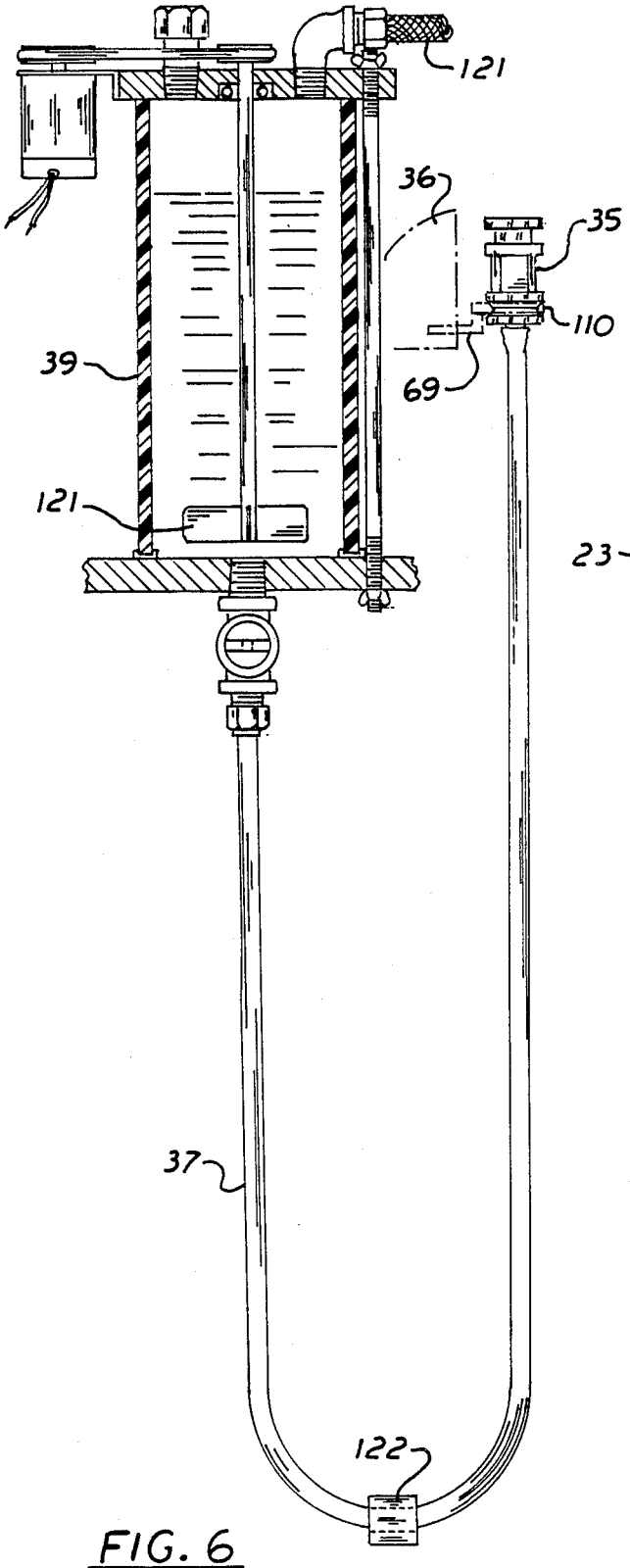
FIG. 6 shows an arrangement of a paint pod connected with flexible conduit to a paint reservoir.

FIG. 6 illustrates another advantageous feature of a preferred embodiment. Paint reservoir 39 may contain stirrer means 121 for maintaining fluid homogeneity and preferably is pressurized by compressed air through inlet 121 from a source (not shown). When in operation, air pressure forces fluid through flexible conduit 37 into paint pod 35, shown as gripped by grippers 69 at indentation 110 as part of holder 36. An element 122 is used to maintain tension on tubing 37 when the robotic arm is in movement as described herein. Examples of element 122 can be lead weight, spring loaded reel devices, etc. Preferably element 122 is a wrap-around solid material made of lead, metal, or any other relatively heavy material.

Figure 7:
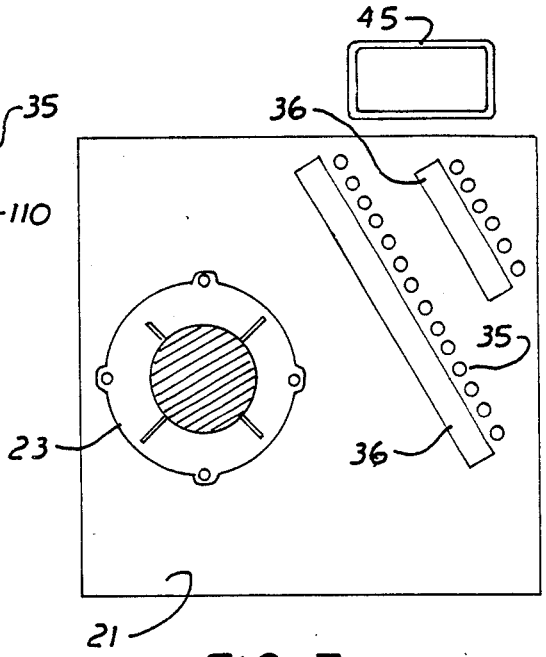
FIG. 7 shows a plan view along Line 7—7 of FIG. 1.
Figure 8:
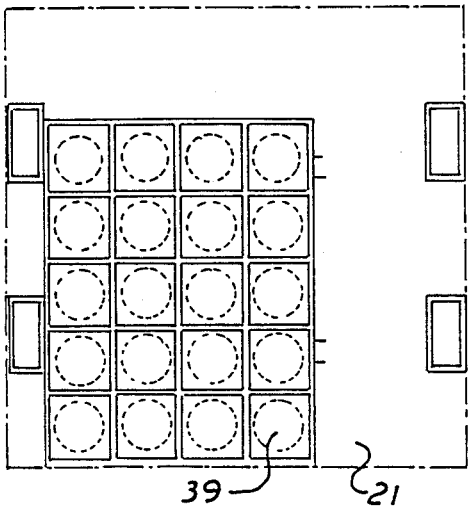
FIG. 8 shows a plan view along Line 8—8 of FIG. 1.

Referring now to FIGS. 7 and 8, an illustrative top plan view is shown. Base 21 supports trunk 23 of robotic arm 20. Convenient locations for holders 36 are shown with twenty separate paint pods 35. Cleaner reservoir 45 is also shown at a remote location. Reservoir holder 39 is illustrated, shown in FIG. 8, as a sliding drawer under the table top of base 21.

Figure 9:
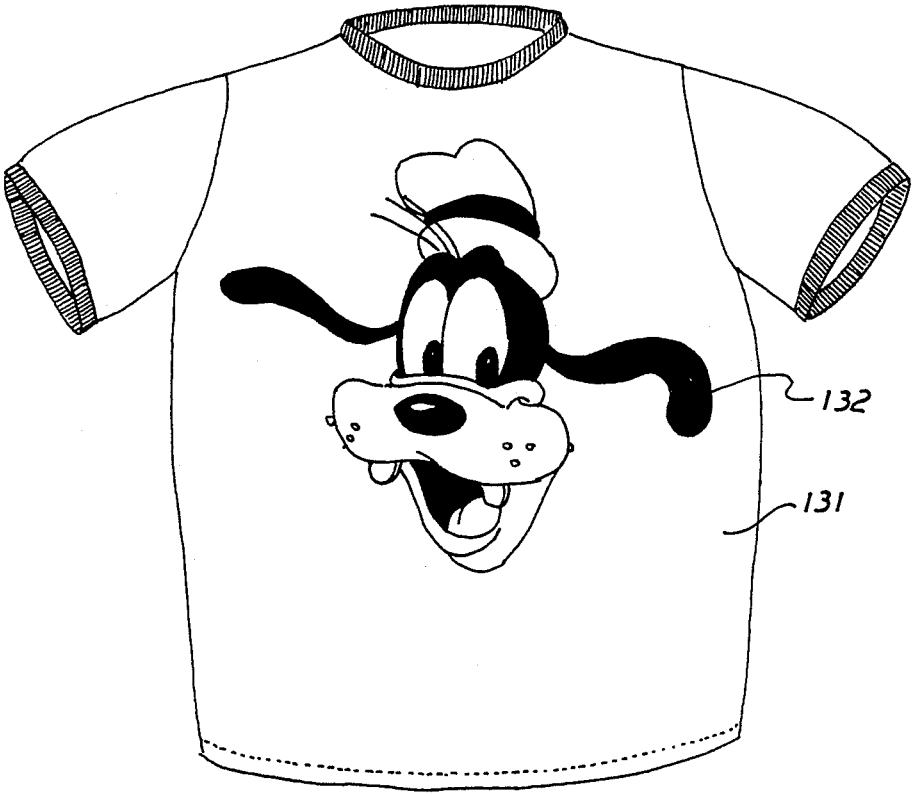
FIG. 9 shows a result obtained in accordance with the present invention when using a fabric T-shirt as the acceptor surface.
Figure 10:
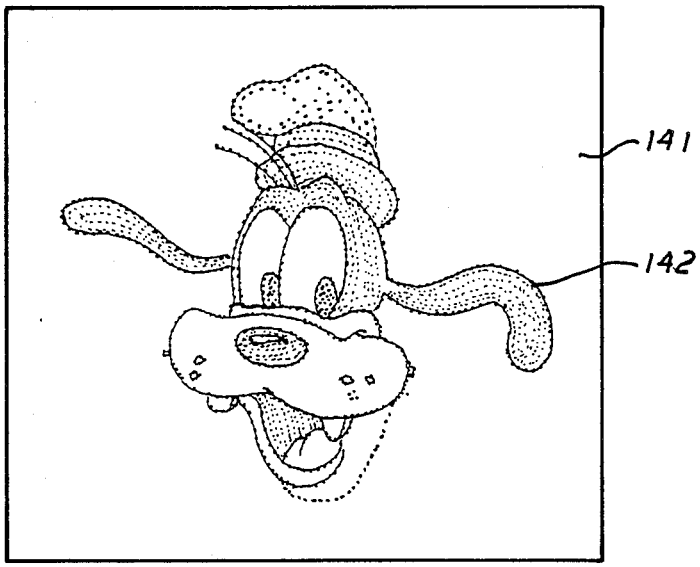
FIG. 10 shows a computer program in accordance with the present invention in a form of punched mat.

FIG. 9 illustrates a result from the practice of an embodiment of this invention whereby a predetermined image 132 is painted on a cloth T-shirt 131. FIG. 10 represents one embodiment of computer instructions on a punched mat form 141. A multiplicity of dot punches 142 are made in the solid mat preferably of paper, in a configuration and color selection which has been preselected by the operator of the apparatus. The punched dots not only set forth the relief outline of the image to be projected to the surface but are coded to the robot controller for color selection as well. The robot controller reads the dots which in turn instructs the movement of the robotic arm in accordance with the map of dots or punched holes. The punched mat is the master painting from which almost an infinite number of exact copies may be obtained from the practice of this invention. Other instructional means may be utilized such as tapes, floppy disks, and programed hard disk drives with software control without departing from the advantages of the present invention.

Although the present invention has been described with reference to preferred embodiments, numerous modifications and rearrangements can be made and still the result will come within the scope of the invention.

What is claimed is:

1. An apparatus that repeatedly reproduces duplicate copies of a work of the visual arts, comprising:

an airbrush member;

a normally closed flow control means that regulates the flow of fluid through said airbrush member;

a plurality of sources of paint of differing colors, each of said sources being under positive pressure;

each of said sources of paint being substantially permanently positioned at a predetermined location;

a plurality of elongate, flexible conduit means each of which has a first end disposed in substantially permanent fluid communication with an associated source of paint;

a normally closed valve means positioned at a second end of each of said conduit means;

each of said conduit means being filled with paint under positive pressure along its extent;

each of said normally closed valve means being positioned at a fixed predetermined location when not in use;

a first plurality of fixed location gripper members that releasably grip said normally closed valve means when said normally closed valve means are not in use, there being as many gripper members as there are normally closed valve means;

a hollow quill member that has a first end disposed within said airbrush member and a second end that projects outwardly from said airbrush member;

said airbrush member being mounted at the distal free end of a computerDcontrolled robotic arm;

a second gripper member being mounted on and thus being movable with said airbrush member;

a computer means that controls movement of said robotic arm and hence of said airbrush member;

said quill member being slidably received within a preselected normally closed valve means and being operative to open said preselected valve means to paint flow when said second gripper member grips said preselected normally closed valve means;

said computer means being operative to guide said robotic arm and hence said airbrush member along a predetermined path of travel relative to a paint-accepting surface;

said computer means being operative to direct said second gripper member to sequentially engage different preselected normally closed valve means and to direct said first plurality of gripper members to release their associated normally closed valve means upon gripping thereof by said first gripper member; and said computer means being operative to control the normally closed valve means of said airbrush member;

all of said operations of said computer means being timed and sequenced so that paint of different colors is applied to said paint-accepting surface in predetermined locations at a predetermined rate of flow to thereby reproduce a preselected work.

2. The apparatus of claim 1, wherein each of said normally closed valve means is a paint pod member having two separate gripping surfaces, a first gripping surface being engaged by an associated first gripper member when said paint pod member is not in use, and a second gripping surface being engaged by said second gripper member when said paint pod member is in use.

3. The apparatus of claim 2, further comprising a sensing means that detects whether said second gripper member is gripping a paint pod member and whether a particular one of said plurality of first gripper members is gripping a paint pod member.

4. The apparatus of claim 3, wherein said paint accepting surface is mounted on a hollow base member, and wherein said base member is apertured to receive a nozzle means associated with said airbrush member so that paint to be emptied from said airbrush member may be deposited into a waste paint receiving cavity defined by said hollow base member.

5. A method of producing multiple copies of a work, comprising the steps of:

converting a work of the visual arts into bits of information and storing said information in a memory means;

providing a surface upon which said work is to be reproduced;

placing a paint reservoir means containing paint under positive pressure into fluid communication with a conduit means;

placing a normally closed valve means at an end of said conduit means remote from said paint reservoir means;

mounting said airbrush means at the terminus of a robotic arm having plural degrees of freedom;

providing tubular quill means as a part of said airbrush means;

opening said normally closed valve means by bringing it into engagement with said quill means;

providing a paint flow control means; and reproducing said work by reading said memory means, said information instructing said robotic arm to follow a predetermined path of travel and said information simultaneously instructing said paint flow control means to regulate the flow of paint from said reservoir means sequentially through said normally closed valve means, said quill means and said airbrush means in the recited sequence and hence onto said second surface so that the visual image is reproduced.

6. The method of claim 5, further comprising the steps of:

providing plural paint reservoir means under positive pressure containing differing colors of paint;

placing a normally closed valve means in substantially permanent fluid communication with an associated paint reservoir means;

positioning said normally closed valve means in predetermined locations and storing information concerning the location of each normally closed valve means and color of paint obtainable therefrom in said memory means;

enabling said robitic arm to selectively grip and release individual normally closed valve means to place said airbrush means into and out of fluid communication with said reservoirs of paint, respectively; and instructing said robotic arm to retrieve and replace said normally closed valve means in sequence as needed during the reproduction of said visual image.

7. The method of claim 6, further comprising the step of positioning gripping and releasing means for gripping and releasing said normally closed valve means at each of said predetermined locations assigned to said normally closed valve means.

8. The method of claim 7, further comprising the step of forming a pair of spaced grippable surfaces on each of said normally closed valve means so that each normally closed valve means may be gripped at a first grippable surface by said robotic arm and at a second grippable surface by said normally closed valve means gripping means releasing means.

9. The method of claim 8, further comprising the step of instructing said normally closed valve means gripping and releasing means to release a normally closed valve means only when that normally closed valve means is simultaneously gripped by said robotic arm and only when the paint to be supplied through said normally closed valve means is next required by said airbrush means in reproducing said visual image.

10. The method of claim 9, further comprising the step of instructing said robotic arm to release a normally closed valve means to the grip of said normally closed valve means gripping and releasing means only after said normally closed valve means has been gripped by said gripping and releasing means.

11. The method of claim 6, further comprising the step of positioning a bias means within each normally closed valve means so that said normally closed valve means is closed to fluid flow when it is not engaged by said robotic arm.

12. The method of claim 6, further comprising the steps of:

controlling the flow of paint through said airbrush means by providing a motor means having an output shaft that extends and retracts along its longitudinal axis of symmetry as instructed by said memory means, and linking said output shaft to a trigger means that operates a valve means forming a part of said airbrush means.

13. The method of claim 6, furhter comprising the step of:

providing said robotic arm with sensing that determines the presence or absence of a normally closed valve means in the grip of said robotic arm or in a predetermined position assigned to a normally closed valve means.

14. The method of claim 5, further comprising the step of providing said robotic arm with at least two degrees of freedom.

15. A method of duplicating a work of the visual arts, comprising the steps of:

placing an airbrush means having a flow control means in fluid communication with a source of paint under positive pressure;

mounting said airbrush means to a computer controlled robotic arm having plural degrees of freedom;

moving said airbrush means relative to paint accepting surface along a predetermined path of travel while simultaneously adjusting the flow of paint through said airbrush means as required to duplicate said work;

positioning plural sources of different colored paint under positive pressure in preselected locations and sequentially connecting the airbrush means with predetermined individual sources of paint as required to duplicate said work;

placing an equal number of elongate flexible conduit means in fluid communication with each of said sources of paint, and closing a remote end of each of said conduit means with a normally closed valve means that opens to paint flow only when it is engaged by said airbrush means;

positioning a normally closed valve means between each of said sources of paint and said airbrush means, and configuring said airbrush means to open said normally closed valve means to paint flow only when said normally closed valve means is engaged by said airbrush means.

16. A method of painting a visual image with a robot means programmed to continually repeat a series of steps so that the visual image is continuously duplicated, comprising the steps of:

arranging as many paint holding container members at a first predetermined location as there are different colors of paint in the visual image to be reproduced;

applying a positive pressure to the paint in said container members;

arranging a like number of normally closed valve means at a second predetermined location;

extending a flexible conduit means between each of said container members and a normally closed valve means such that a first end of said conduit means is coupled to its associated container member and a remote second end of said conduit means is coupled to said normally closed valve means;

positioning an airbrush means on a robotic arm;

providing a quill means capable of opening said normally closed valve means as a part of said airbrush means;

instructing said robotic arm to carry said airbrush means to a first preselected normally closed valve means;

thereafter placing said quill means and said normally closed valve means in fluid communication with one another so that paint in a container member associated with said valve means may flow through said airbrush means;

instructing said robotic arm and hence said airbrush means to follow a first predetermined path of travel relative to a paint-accepting surface while said paint is flowing through said airbrush means;

simultaneously controlling the flow rate of paint through said airbrush means;

terminating the flow of paint when the robotic arm completes said first path of travel;

instructing said robotic arm to return said first valve means to its predetermined position;

instructing said robotic arm to select a second normally closed valve means;

thereafter instructing said robotic arm to follow a second predetermined path of travel while said airbrush means is applying paint to said paint accepting surface;

instructing said robotic arm to return said second valve means to its predetermined position; and instructing said robotic arm to repeat said steps as many times as there are colors in the visual image to be reproduced.

17. An apparatus capable of repetitively producing copies of an airbrushed work of the visual arts, comprising:

a robotic arm;

an airbrush member carried by said robotic arm at a free end thereof;

a paint pod member having first and second gripping surfaces formed therein in spaced relation to one another;

a first gripper member adapted to grip said first gripping surface of said paint pod member;

a second gripper member adapted to grip said second gripping surface of said paint pod member;

said first gripper member being permanently disposed in a preselected location; and said second gripper member being mounted on the free end of said robotic arm and being movable therewith.

18. The apparatus of claim 17, further comprising:

a sensing means mounted on said free end of said robotic arm;

said sensing means positioned to sense the presence or absence of a paint pod member in said first or second gripper member; and said sensing means adapted to provide information concerning the presence or absence of a paint pod member in said first or second gripper member to a computer means.

19. The apparatus of claim 18, wherein said paint pod member includes a normally closed valve means therein.

20. The apparatus of claim 19, further comprising valve opening means for opening said normally closed valve means only when said second gripper means is gripping said paint pod means.

21. The apparatus of claim 20, wherein said valve opening means is a tubular quill member having a first end thereof in open communication with the interior of said airbrush member and a second end thereof that projects outwardly from said airbrush member.

22. The apparatus of claim 21, wherein said paint pod member has a bore means formed therein that slidingly receives the second end of said quill member.

23. The apparatus of claim 22, wherein said paint pod member includes a biased valve means that closes said bore means when said quill member second end is not disposed therein.

24. The apparatus of claim 17, further comprising a computer means that instructs said first gripper member to grip said paint pod member until said paint pod member is also gripped by said second gripping member at which time said computer means instructs said first gripper member to release said paint pod member.

25. The apparatus of claim 17, further comprising a source of paint of a preselected color disposed at a preselected location, said paint being under a positive pressure;

a flexible conduit means having a first end in permanently open fluid communication with said source of paint and a second end in permanent fluid communication with said paint pod member;

said paint pod member being a normally closed valve means so that paint under positive pressure fills said conduit means along its entire extent and does not flow through said conduit means until said normally closed valve is opened.

26. The apparatus of claim 25, wherein said airbrush member is adapted to open said normally closed valve means when said paint pod member is gripped by said second gripper member, whereby paint flows through said paint pod member into said airbrush member but is not discharged from said airbrush member until said airbrush member is activated.

27. The apparatus of claim 26, wherein a tubular quill member associated with said airbrush member opens said normally closed valve means when said piant pod member is gripped by said second gripper member.

* * * * *